US005158927A

United States Patent [19]

Bailey et al.

[11] Patent Number: 5,158,927

[45] Date of Patent: Oct. 27, 1992

[54] POLYVINYL ALCOHOL/POLYMERIC BARRIER OVERCOATS ON COLOR FILTER ARRAYS

[75] Inventors: David B. Bailey; Helmut Weber, both of Webster, N.Y.

[73] Assignee: Eastman Kodak Company, Rochester, N.Y.

[21] Appl. No.: 838,623

[22] Filed: Feb. 19, 1992

[51] Int. Cl.[5] ..... B41M 5/035; B41M 5/26

[52] U.S. Cl. ..... 503/227; 428/195; 428/210; 428/520; 428/913; 428/914; 430/7; 430/200; 430/201; 430/945

[58] Field of Search ..... 8/471; 428/195, 210, 428/520, 913, 914; 430/7, 200, 201, 945; 503/227

[56] References Cited

FOREIGN PATENT DOCUMENTS 62-97888 10/1985 Japan ..... 503/227

*Primary Examiner*—B. Hamilton Hess

*Attorney, Agent, or Firm*—Harold E. Cole

[57] ABSTRACT

This invention relates to a process of forming a color filter array element comprising:

a) imagewise-heating a dye-donor element comprising a support having thereon a dye layer;

b) transferring portions of the dye layer to a dye-receiving element comprising a support having thereon a polymeric dye image-receiving layer, the imagewise-heating being done in such a way as to produce a repeating pattern of colorants forming a color filter array, c) coating the color filter array with a polyvinyl alcohol layer;

d) coating the polyvinyl alcohol layer with a polymeric barrier layer such as a dye image-receiving layer; and e) heating the color filter array to further diffuse the dye into the dye image-receiving layer.

7 Claims, No Drawings

POLYVINYL ALCOHOL/POLYMERIC BARRIER OVERCOATS ON COLOR FILTER ARRAYS

This invention relates to a process of coating an imaged thermal dye transfer receiver in the form of a color filter array with a polyvinyl alcohol layer followed by a barrier layer in order to prevent dye smear and density loss.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083.726A, the disclosure of which is hereby incorporated by reference.

Liquid crystal display devices are known for digital display in electronic calculators, clocks, household appliances, audio equipment, etc. Liquid crystal displays are being developed to replace cathode ray tube technology for display terminals. Liquid crystal displays occupy a smaller volume than cathode ray tube devices with the same screen area. In addition, liquid crystal display devices usually have lower power requirements than corresponding cathode ray tube devices.

There has been a need to incorporate a color display capability into such monochrome display devices, particularly in such applications as peripheral terminals using various kinds of equipment involving phototube display, mounted electronic display, or TV-image display. Various attempts have been made to incorporate a color display using a color filter array element into these devices. However, none of the color array elements for liquid crystal display devices so far proposed have been successful in meeting all the users' needs.

One commercially-available type of color filter array element which has been used in liquid crystal display devices for color display capability is a transparent support having a gelatin layer thereon which contains dyes having the additive primary colors red, green and blue in a mosaic pattern obtained by using a photolithographic technique. To prepare such a color filter array element, a gelatin layer is sensitized, exposed to a mask for one of the colors of the mosaic pattern, developed to harden the gelatin in the exposed areas, and washed to remove the unexposed (uncrosslinked) gelatin, thus producing a pattern of gelatin which is then dyed with dye of the desired color. The element is then recoated and the above steps are repeated to obtain the other two colors. Misalignment or improper deposition of color materials may occur during any of these operations. This method therefore contains many labor-intensive steps, requires careful alignment, is time-consuming and very costly. Further details of this process are disclosed in U.S. Pat. No. 4,081,277. U.S. Pat. No. 4,786,148 also discloses a color filter array element which employs certain pigments.

Color liquid crystal display devices generally include two spaced glass panels which define a sealed cavity which is filled with a liquid crystal material. For actively-driven devices, a transparent electrode is formed on one of the glass panels, which electrode may be patterned or not, while individually addressable electrodes are formed on the other of the glass panels. Each of the individual electrodes has a surface area corresponding to the area of one picture element or pixel. If the device is to have color capability, a color filter array with, e.g., red, green and blue color areas must be aligned with each pixel. Depending upon the image to be displayed, one or more of the pixel electrodes is energized during display operation to allow full light, no light or partial light to be transmitted through the color filter areas associated with that pixel. The image perceived by a user is a blending of colors formed by the transmission of light through adjacent color filter areas.

In forming such a liquid crystal display device, the color filter array element to be used therein may have to undergo rather severe heating and treatment steps during manufacture. For example, a transparent conducting layer, such as indium tin oxide (ITO), is usually vacuum sputtered onto the color filter array element which is then cured and patterned by etching. The curing may take place at temperatures elevated as high as 200° C. for times which may be as long as one hour or more. This is followed by coating with a thin polymeric alignment layer for the liquid crystals, such as a polyimide, followed by another curing step for up to several hours at an elevated temperature. These treatment steps can be very harmful to many color filter array elements, especially those with a gelatin matrix.

In JP 62/97888, a heat transfer recording method is disclosed wherein a polyvinyl alcohol layer is coated over a thermally-transferred image in order to prevent the dye from transferring to another surface during storage. While it has been found that this method improves "dye smear" in making a color filter array, there is another problem with that method in that the dye density is not as high as one would like it to be.

It is an object of this invention to provide a method for preparing a color filter array wherein a polyvinyl alcohol layer is coated over the thermally-transferred image in the form of a color filter array and wherein the transferred image has an improved "dye smear" and higher density.

These and other objects are achieved in accordance with this invention which pertains to a process of forming a color filter array element comprising:

a) imagewise-heating a dye-donor element comprising a support having thereon a dye layer;
b) transferring portions of the dye layer to a dye-receiving element comprising a support having thereon a polymeric dye image-receiving layer, the imagewise-heating being done in such a way as to produce a repeating pattern of colorants forming a color filter array,
c) coating the color filter array with a polyvinyl alcohol layer;
d) coating the polyvinyl alcohol layer with a polymeric barrier layer; and
e) heating the color filter array to further diffuse the dye into the dye image-receiving layer.

In accordance with this invention, the density is significantly improved over that obtained by only coating the thermal dye transfer image with a polyvinyl alcohol layer, as will be shown by comparative data hereafter, while having an improved "dye smear".

Any polyvinyl alcohol may be used in the process of the invention such as Vinol 540®, available commercially from Air Products Co.

Any polymeric material may be used as the barrier layer in the invention, which is in effect a non-solvent for the dye, so that all diffusion is directed towards the image-receiving layer. There may be used, for example, polycarbonates, polyesters, polyimides, vinyl polymers, crosslinkable formulations such as vinyl pyrrolidone/triacetate or epoxies, etc. In a preferred embodiment of the invention, a polymeric dye image-receiving material may be used as the barrier layer. In that case, any dye which diffuses through the polyvinyl alcohol layer will be trapped in this second dye image-receiving layer. It should be present in sufficient thickness to retain the dye.

A color filter array element according to the invention comprises a repeating pattern of colorants in the polymeric dye image-receiving layer such as a mosaic pattern, preferably a set of red, green and blue additive primaries.

The size of the mosaic set is not critical since it depends on the viewing distance. In general, the individual pixels of the set are from about 50 to about 600 μm and do not have to be of the same size.

In a preferred embodiment of the invention, the repeating mosaic pattern of dye to form the color filter array element consists of uniform, square, linear repeating areas, with one color diagonal displacement as follows:

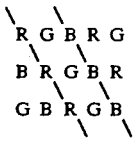

In another preferred embodiment, the above squares are approximately 100 μm.

The color filter array elements prepared according to the invention can be used in image sensors or in various electro-optical devices such as electroscopic light valves or liquid crystal display devices. Such liquid crystal display devices are described, for example, in UK Patents 2,154,355; 2,130,781; 2,162,674 and 2,161,971.

Liquid crystal display devices are commonly made by placing a material, which is liquid crystalline at the operating temperature of the device, between two transparent electrodes, usually indium tin oxide coated on a substrate such as glass, and exciting the device by applying a voltage across the electrodes. Alignment layers are provided over the transparent electrode layers on both substrates and are treated to orient the liquid crystal molecules in order to introduce a twist of, e.g., 90°, between the substrates. Thus, the plane of polarization of plane polarized light will be rotated in a 90° angle as it passes through the twisted liquid crystal composition from one surface of the cell to the other surface. Application of an electric field between the selected electrodes of the cell causes the twist of the liquid crystal composition to be temporarily removed in the portion of the cell between the selected electrodes. By use of optical polarizers on each side of the cell, polarized light can be passed through the cell or extinguished, depending on whether or not an electric field is applied.

The polymeric alignment layer described above may be any of the materials commonly used in the liquid crystal art. Such materials include polyimides, polyvinyl alcohol, methyl cellulose, etc.

The transparent conducting layer described above is also conventional in the liquid crystal art. Such materials include indium tin oxide, indium oxide, tin oxide, cadmium stannate, etc.

The dye image-receiving layer used in the process of the invention may comprise, for example, those polymers described in U.S. Patents 4,695,286, 4,740,797, 4,775,657 and 4,962,081, the disclosures of which are hereby incorporated by reference. In a preferred embodiment, polycarbonates having a glass transition temperature greater than about 200° C. are employed. In another preferred embodiment, polycarbonates derived from a methylene substituted bisphenol-A are employed such as 4,4'-(hexahydro-4,7-methanoindan-5-ylidene)-bisphenol. In general, good results have been obtained at a coverage of from about 0.25 to about 5mg/m$^2$.

The support for the dye-receiving element that is used in the process of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (a polyester with white pigment incorporated therein), an ivory paper, a condenser paper or a synthetic paper such as duPont Tyvek®. In a preferred embodiment, a glass support is employed such as borax glass, borosilicate glass, chromium glass, crown glass, flint glass, lime glass, potash glass, silica-flint glass, soda glass, and zinc-crown glass.

A dye-donor element that is used in the process of the invention comprises a support having thereon a dye layer. Any dye or mixture of dyes can be used in such a layer provided they are transferable to the dye image-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R-FS ® (Mitsubishi Chemical Industries, Ltd.), and Kayalon Polyol Brilliant Blue N-BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd.), and Aizen Malachite (Hodogaya Chemical Co., Ltd.);

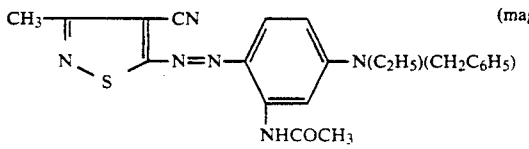

(magenta)

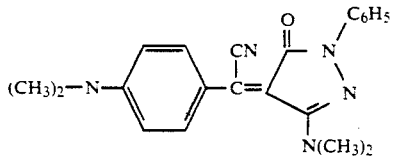

(magenta)

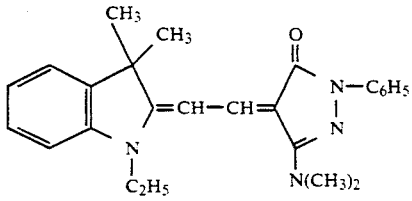

(yellow)

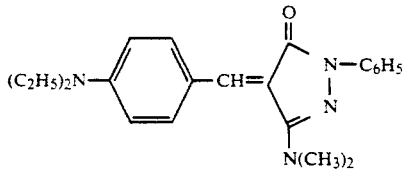

(yellow)

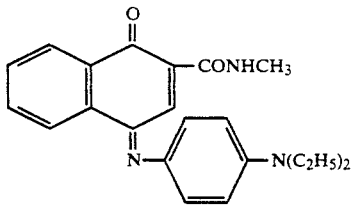

(cyan)

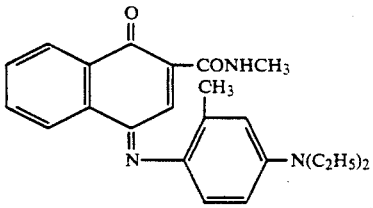

(cyan)

or any of the dyes disclosed in U.S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. The above subtractive dyes may be employed in various combinations to obtain red, blue and green additive primary colors, if desired. The dyes may be mixed within the dye layer or transferred sequentially if coated in separate dye layers. The dyes may be used at a coverage of from about 0.05 to about 1 g/m$^2$.

The imaging dye, and an infrared-absorbing material if one is present, are dispersed in the dye-donor element in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

Various methods may be used to transfer dye from the dye donor to the receiver in the process of the invention. There may be used, for example, a high intensity light flash technique with a dye-donor containing an energy absorptive material such as carbon black or a light-absorbing dye. Such a donor may be used in conjunction with a mirror which has a grid pattern formed by etching with a photoresist material. This method is described more fully in U.S. Pat. No. 4,923,860.

Another method of transferring dye from the dye donor to the receiver in the process of the invention is to use a heated embossed roller as described more fully in U.S. Pat. No. 4,978,952.

In another embodiment of the invention, the imagewise-heating is done by means of a laser using a dye-donor element comprising a support having thereon a dye layer and an absorbing material for the laser, the imagewise-heating being done in such a way as to produce a repeating mosaic pattern of colorants.

Any material that absorbs the laser energy or high intensity light flash described above may be used as the absorbing material such as carbon black or nonvolatile infrared-absorbing dyes or pigments which are well known to those skilled in the art. In a preferred embodiment, cyanine infrared absorbing dyes are employed as described in U.S. Pat. No. 4,973,572, or other materials as described in the following U.S. Pat. Nos.: 4,948,777; 4,950,640; 4,950,639; 4,948,776; 4,948,778; 4,942,141; 4,952,552 and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing material may be contained in the dye layer itself or in a separate layer associated therewith.

After the dyes are transferred to the receiver, the color filter array image is heated to further diffuse the dye into the dye-receiving layer in order to stabilize the image. This may be done by radiant heating or by contact with heated rollers. The fusing step aids in preventing fading and surface abrasion of the image upon exposure to light and also tends to prevent crystallization of the dyes.

The following example is provided to illustrate the invention.

EXAMPLE

Red dye-donors were prepared by coating on a gelatin subbed transparent 175 μm poly(ethylene terephthalate) support a dye layer containing a mixture of the first magenta dye illustrated above (0.30 g/m$^2$) and the yellow dye illustrated below (0.25 g/m$^2$) in a cellulose acetate propionate (2.5% acetyl, 46% propionyl) binder (0.27 g/m$^2$) from a 1-propanol, butanone, toluene and cyclopentanone solvent mixture. The dye layer also contained Regal 300 Carbon ® (Cabot Co.) (0.22 g/m$^2$) ball-milled to submicron particle size, Fluorad FC-431 ® dispersing agent (3M Company) (0.01 g/m$^2$) and Solsperse 24000 ® dispersing agent (ICI Corp.) (0.03 g/m$^2$).

Yellow Dye:

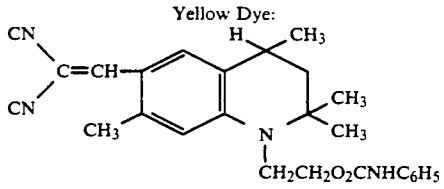

Green dye donors were prepared as described above except a mixture of the cyan dye (0.28 g/m$^2$) illustrated below and yellow dye (0.26 g/m$^2$) illustrated above were used.

Cyan Dye:

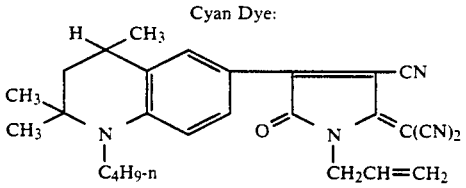

Blue dye donors were prepared as described above but the single blue dye (0.47 g/m$^2$) illustrated below was used.

Blue Dye

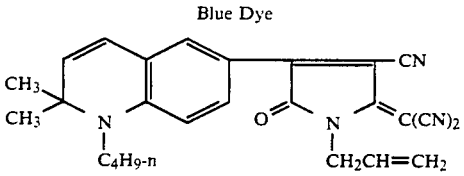

Dye receivers were prepared by spin-coating the following layers on a 1.1 mm thick flat-surfaced borosilicate glass:

1) Subbing layer of duPont VM-651 Adhesion Promoter as a 1% solution in a methanol-water solvent mixture (0.5 μm thick layer equivalent to 0.54 g/m$^2$), and
2) Receiving layer of a polycarbonate of 4,4'-(hexahydro-4,7-methanoindene-5-ylidene) bisphenol (2.5 g/m$^2$), as described in U.S. Pat. No. 4,962,081 from ethyl benzoate.

After coating, the receiver plate was heated at 60° C. in an oven to remove residual solvent.

Each of the above dye-donors was separately imaged by placing the dye-donor face down upon the dye-receiver. A Mecablitz Model 402 ® (Metz AG Company) electronic flash unit was used as a thermal energy source. It was placed 40 mm above the dye-donor using a 45-degree mirror box to concentrate the energy from the flash unit to a 25×50 mm area. The overall dye transfer area was masked to 12×40 mm. The flash unit was flashed once to produce a transferred Status A transmission density of at least 0.5. This printing sequence was repeated with the other donors to produce the individual areas of red, green, or blue dye on each receiver.

The color filter array image was then buried in a sandwich structure. The sandwich was generated by first spin-coating an overcoat layer of Vinol 540 ® (a polyvinyl alcohol) (0.3 g/m$^2$) from an aqueous solution and then air drying. A second layer of the same polymer used as the dye receiving layer (the polycarbonate of 4,4-(hexahydro-4,7-methanoidene-5-ylidene) bisphenol) (2.5 g/m2) was coated on top of the polyvinyl alcohol layer of the imaged receiver from cyclohexanone.

The polyvinyl alcohol layer serves to prevent smearing of the imaged pattern. When a control receiver with the same image dye pattern but without the polyvinyl alcohol layer was attempted to be coated with the polycarbonate receiving layer, the dye pattern was completely smeared and individual red, green, and blue areas were not distinguishable.

The sandwich structure entraps the dye so that dye diffusion during subsequent heating steps is limited to either the top or bottom image-receiving layers. Dye is therefore not lost or attacked by the atmosphere. The polyvinyl alcohol layer alone is insufficient to prevent dye loss. To evaluate the effect of dye density loss upon heating, the imaged receiver with both the polyvinyl alcohol layer and polycarbonate layer was heated at 270° C. for three minutes. A control imaged receiver with only the polyvinyl alcohol layer was heated in the same manner. Microdensitometer Status A readings were obtained for each of the red, green, and blue areas as follows:

| | STATUS A DENSITY | |
|---|---|---|
| | Polyvinyl Alcohol Overcoat Only | Polyvinyl Alcohol/ Polycarbonate Dual Overcoat |
| Red Dye Area | 1.0 (G) | 2.1 (G) |
| | 1.0 (B) | 2.0 (B) |
| Green Dye Area | 0.9 (R) | 1.8 (R) |
| | 0.9 (B) | 2.2 (B) |
| Blue Dye Area | 0.3 (R) | 0.5 (R) |
| | 0.5 (G) | 1.1 (G) |

The above data show that the receiver with the two protective layers retained dye much better than the control with only the single polyvinyl alcohol layer.

The invention has been described in detail with particular reference to preferred embodiments thereof, but it will be understood that variations and modifications can be effected within the spirit and scope of the invention.

What is claimed is:

1. A process of forming a color filter array element comprising:

a) imagewise-heating a dye-donor element comprising a support having thereon a dye layer;
b) transferring portions of said dye layer to a dye-receiving element comprising a support having thereon a polymeric dye image-receiving layer, said imagewise-heating being done in such a way as to produce a repeating pattern of colorants forming a color filter array,
c) coating said color filter array with a polyvinyl alcohol layer;
d) coating said polyvinyl alcohol layer with a polymeric barrier layer; and e) heating said color filter array to further diffuse the dye into said dye image-receiving layer.

2. The process of claim 1 wherein said imagewise-heating is performed by a laser.

3. The process of claim 1 wherein said dye-donor element has an infrared-absorbing material associated therewith.

4. The process of claim 3 wherein said infrared-absorbing material is an infrared-absorbing dye.

5. The process of claim 1 wherein said support for said dye-receiving element is glass.

6. The process of claim 1 wherein said imagewise-heating is performed by a high intensity light flash.

7. The process of claim 1 wherein said barrier layer is a dye image-receiving layer.

* * * * *